United States Patent [19]

Luinstra et al.

[11] Patent Number: 4,660,682

[45] Date of Patent: Apr. 28, 1987

[54] LIFT CAR SUPPORT

[75] Inventors: Mark F. Luinstra, Miranda; Stephen McGloin, Yarrawarrah, both of Australia

[73] Assignee: Elevators Pty. Limited, Waterloo, Australia

[21] Appl. No.: 831,076

[22] Filed: Feb. 19, 1986

Related U.S. Application Data

[63] Continuation of Ser. No. 549,447, Nov. 4, 1983, abandoned.

[30] Foreign Application Priority Data

Nov. 10, 1982 [AU] Australia ..... PF6740

[51] Int. Cl.[4] ..... B66B 9/00

[52] U.S. Cl. ..... 187/1 R; 248/581

[58] Field of Search ..... 187/1 R, 32, 94; 248/560, 580, 581, 583

[56] References Cited

U.S. PATENT DOCUMENTS 660,724 10/1900 Fischer et al. ..... 187/1 R
1,918,427 7/1933 Rice ..... 187/1 R
2,246,732 6/1941 Hymans ..... 187/1 R
4,113,064 9/1978 Shigeta et al. ..... 187/1 R

FOREIGN PATENT DOCUMENTS 656019 3/1965 Belgium ..... 187/1 R
695566 6/1965 Canada ..... 187/1 R

*Primary Examiner*—Joseph J. Rolla
*Assistant Examiner*—Kenneth Noland
*Attorney, Agent, or Firm*—Owen, Wickersham & Erickson

[57] ABSTRACT

A support structure for a lift car or elevator comprising two pairs of parallel rails and followers arranged in a horizontal parallelogram array between the lift car and support frame, such that compound movement of the followers on their respective rails allows the lift car to move in any horizontal direction to absorb transverse vibration due to misalignment of the vertical guide rails in the lift shaft. Also described are biassing devices arranged to lightly bias the lift car to a centralized horizontal position, and centralizing devices arranged to positively centralize the lift car for entry and egress at each floor.

7 Claims, 11 Drawing Figures

LIFT CAR SUPPORT

This application is a continuation of application Ser. No. 549,447, filed Nov. 4, 1983, now abandoned.

BACKGROUND OF THE INVENTION

This invention relates to a lift car support and in particular to a manner of mounting a lift car in a supporting frame to permit a limited degree of horizontal movement of the lift car relative to the frame.

In the case of high speed lifts or elevators in particular, it has been recognised that slight mis-alignment of the guide rails in the lift shaft, or movement of the building due to wind loads or other causes, may induce transverse vibrations in a lift car during operation. The lift car is suspended within or from a framework to which the lift hoisting mechanism is attached, and the lift car can move transversely due to various applied forces. This transverse movement or vibration can cause some degree of discomfort or uneasiness to the occupiers of the lift car.

Australian Patent Specification No. 464,496 discloses the proposal of a freely moving lift car mounted either like a pendulum or freely on ball bearings retained in bolsters, means being provided for cushioning the lift car against the frame and preventing over-movement.

A further development in the art was proposed by the present applicants and is described in Australian Patent Specification No. 43223/80 in which there is disclosed a lift car suspension which in the preferred embodiment is known as "a Ball's point suspension".

However it is still considered desirable to provide alternative methods of mounting the lift car in the support frame which can be readily constructed into lift cars either as original equipment or as a modification to be fitted subsequently. Furthermore, it is desirable that any such design achieve compactness and easy access for servicing.

SUMMARY OF THE INVENTION

It is therefore an object of the present invention to provide a support structure for a lift car which will go at least part of the way toward meeting the foregoing desiderata in a simple yet effective manner, or which will at least provide the public with a useful choice.

Accordingly the invention consists in a support structure for a lift car, comprising a frame adapted to be connected to a lift hoisting mechanism to support the lift car, first and second pairs of parallel rails arranged substantially horizontally in a parallelogram configuration between the lift car and the frame, and first and second sets of followers arranged to roll or slide on said first and second pairs of rails respectively, said lift car being supported from said frame by way of said rails and followers in a manner such that one pair of rails is supported from the other pair of rails by way of at least one said set of followers and can traverse along the line of the other pair of rails allowing the lift car to move in any horizontal direction relative to the frame.

In the preferred form of the invention the frame incorporates portions located beneath the lift car, and the rails and followers are located beneath the lift car between the lift car floor and the frame.

It is preferred that the first pair of rails is substantially at right angles to the second pair of rails so that the parallelogram configuration becomes a square or rectangle.

In one particular embodiment of the invention the first pair of rails is mounted on the frame, the second pair of rails is mounted on the lift car, and the sets of followers are mounted back-to-back in four bogies, each bogie incorporating one of the first set of followers and one of the second set of followers.

In an alternative embodiment of the invention the first pair of rails is mounted on the frame, the second pair of rails is mounted on the first set of followers, and the lift car is mounted on the second set of followers.

In one form of the invention the followers are provided with wheels which roll on the rails and in a further form of the invention the followers may be linear bearings such as recirculating ball bearings which slide on appropriately profiled rails.

The invention also envisages the provision of positive centralising means adapted to centralise the lift car to a datum position relative to the frame when the lift is stationary at any particular floor of the building for loading or unloading.

In the preferred form of the invention the centralising means comprise a toggle brace arrangement mounted on the frame wherein the central knuckle of the toggle is movable transversely by a linear actuator causing the outer ends of the toggle to move toward and away from one another, to and from retracted and extended positions, and wherein the outer ends of the toggle mechanism are provided with V-shaped notches arranged to engage rotatable wheels protruding downwardly from the lift car when the toggle is in the extending position.

DESCRIPTION OF THE DRAWINGS

Notwithstanding any other forms that may fall within its scope, one preferred form of the invention will now be described by way of example only with reference to the accompanying drawings, in which.

DESCRIPTION OF THE PREFERRED EMBODIMENT

Figure 2:
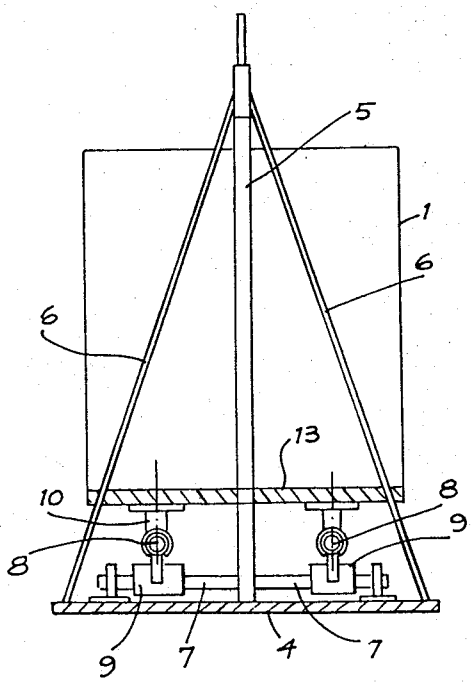
FIG. 2 is a corresponding side elevation of the embodiment shown in FIG. 1.
Figure 1:
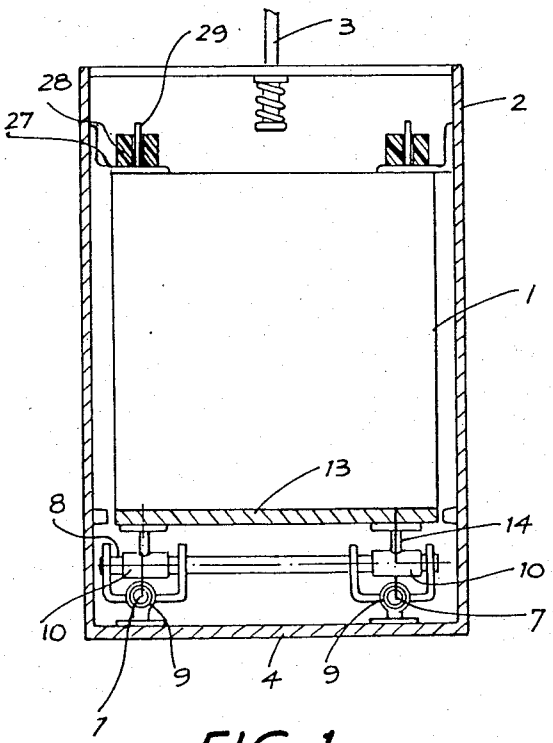
FIG. 1 is a diagrammatic part sectional front elevation of a lift car and support structure according to a first embodiment of the invention.

In the preferred form of the invention a lift car 1 is supported in a cage 2 which is typically connected to a lift hoisting mechannism by a cable 3. The cage is guided by guide rails at either side of the lift shaft (not shown) for vertical movement of the cage and hence the lift car within the lift shaft. The lift cage incorporates a lower support frame 4 which may be an integral part of the cage 2 as shown in FIGS. 1, 2, 7 and 8, or alternatively may be an additional portion which is bolted on to an existing lift cage to modify a lift which is already in service. The lower frame 4 is supported by the upright members 5 of the lift cage and also by diagonal braces 6.

The lift car is supported in the cage by a support structure comprising the frame 4, a first pair of rails 7, a second pair of rails 8, a first set of followers 9 arranged to roll or slide on the first pair of rails, and a second set of followers 10 arranged to roll or slide on the second pair of rails.

The first pair of rails are parallel to one another and similarly the second pair of rails are also parallel to one another and all of the rails are arranged substantially horizontally in a parallelogram configuration between the lift car 1 and the frame 4. In the preferred form of the invention the first pair of rails is at right angles to the second pair of rails so that the parallelogram comprises a rectangle or square.

In a first embodiment of the invention as shown in FIGS. 1 to 6, the first pair of rails 7 are mounted on the frame 4, for example by way of mounting trunions 11. The first set of followers 9 are free to slide or roll on the rails 7 and in turn are provided with mounting brackets 12 arranged to support the second pair of rails 8. The floor 13 of the lift car 1 is in turn supported on the second set of followers 10 by way of suitable support brackets 14.

The rails and followers may take any suitable form but in the embodiment shown in FIGS. 1 to 6 the rails are circular in section and the followers comprise linear bearings and preferably recirculating ball bearings.

Because the lift car is free to move in one horizontal direction by movement of the followers 10 on the rails 8 and in a different horizontal direction by movement of the followers 9 on the rails 7, it will be apparent that the lift car is free to move in any horizontal direction by compound movement of the respective sets of followers on their respective pairs of rails.

The followers and rails are provided with biasing means arranged to bias the position of the lift car to a central datum position, and in the preferred form of the invention the biasing means comprise helical compression springs 15 acting between one side of the followers and a suitable abutment in the form of a collar 16 on the rails. The characteristics of the springs 15 are chosen so that there is a relatively small biasing force toward the datum position at small displacements immediately adjacent the datum position, and so as to give a very low natural transverse vibration frequency in the order of 1 Hz of the lift car relative to the frame or cage.

Figure 3:
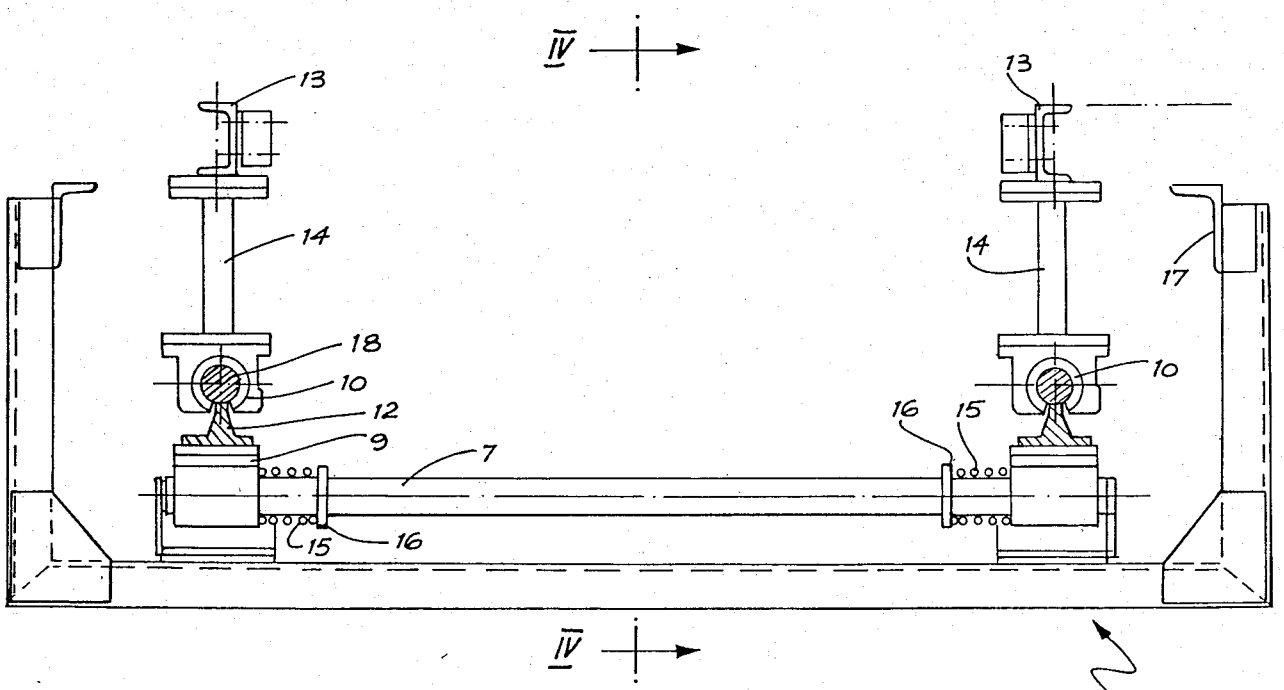
FIG. 3 is an enlarged sectional partial front elevation corresponding to FIG. 2, the section being taken along the line III—III of FIG. 4.
Figure 4:
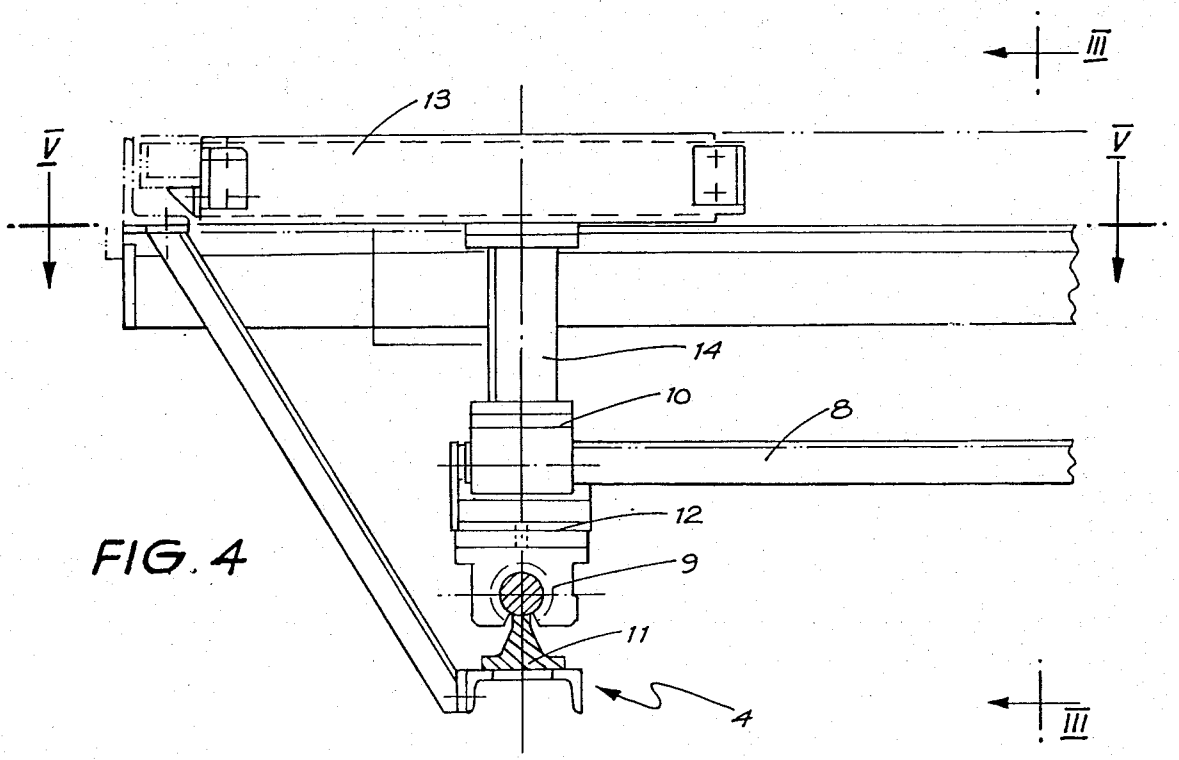
FIG. 4 is a half cross-sectional enlarged side elevation of one side of the lift car support, taken along the line IV—IV of FIGS. 3 and 5.
Figure 5:
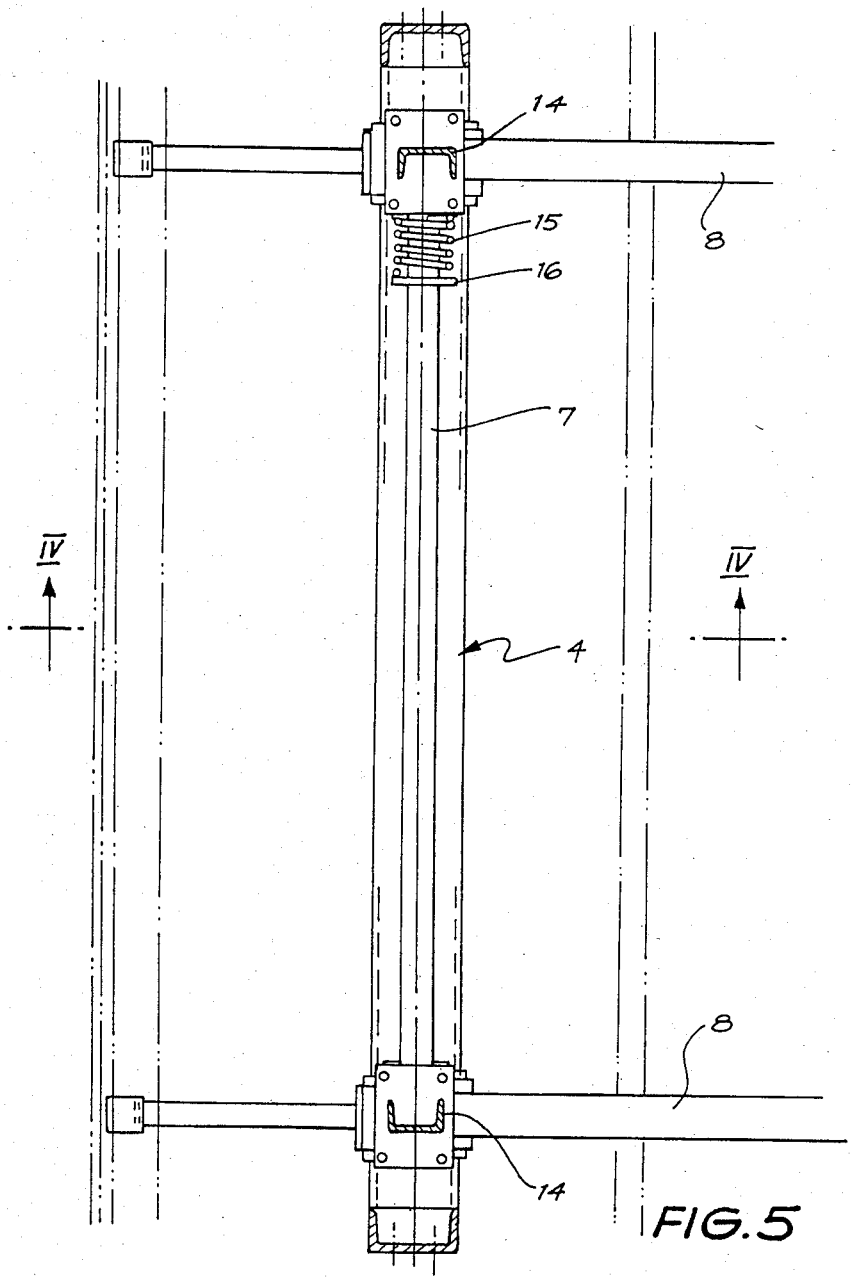
FIG. 5 is a plan view taken partially in cross-section along the line V—V of FIG. 4.
Figure 6:
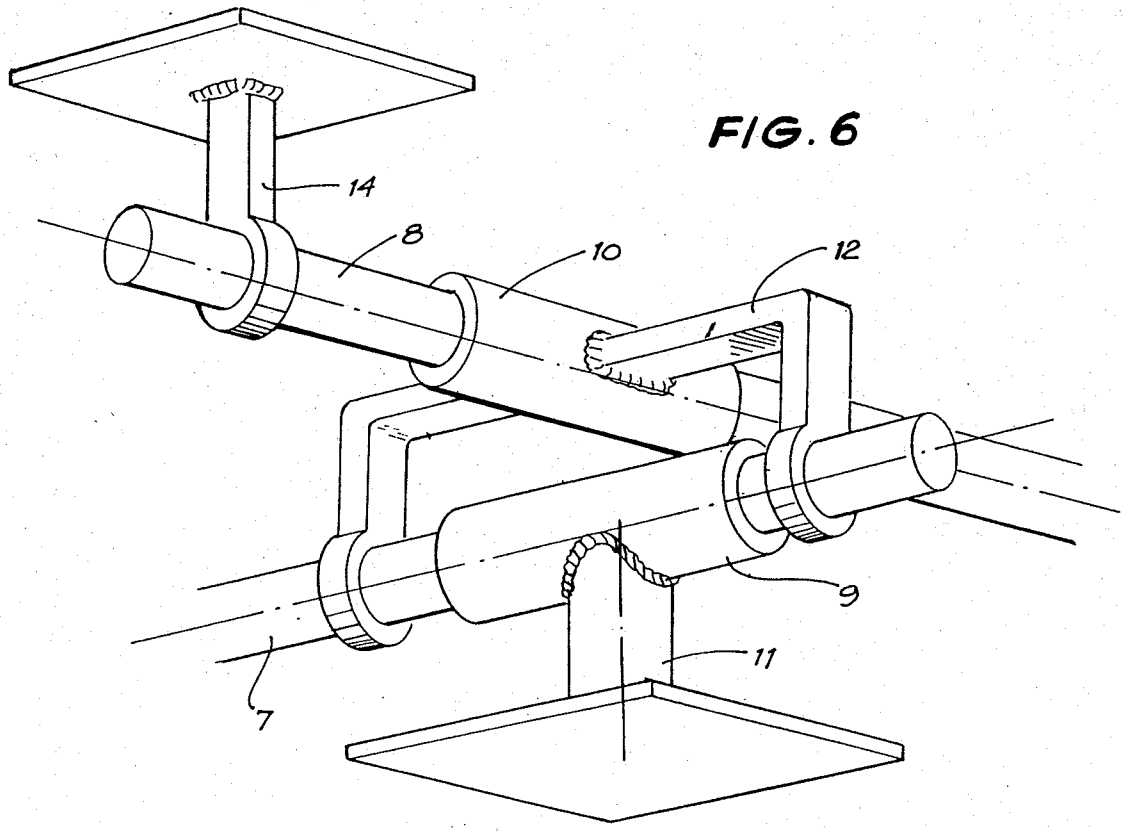
FIG. 6 is an enlarged perspective view of a linear bearing unit which is an alternative to the unit used in the first embodiment of the invention.

As may be most clearly seen in FIG 3, the frame 4 may be provided as a separate component provided with upper mounting flanges 17 which enable the frame and the support structure mounted on the frame to be bolted or otherwise secured to the undersides of existing lift cages.

Although the invention has thus far been described with reference to a support structure wherein the first pair of rails are mounted on the frame and the second pair of rails are mounted for transverse movement on the first pair of rails, it will be apparent that this configuration may be totally inverted or that the second pair of rails may be mounted directly to the underside of the lift car. A further embodiment of the invention incorporating this latter configuration will now be described with reference to FIGS. 7 to 9. Like numerals are used to describe like components where these components are common to the embodiment shown in FIGS. 1 to 6.

Figure 8:
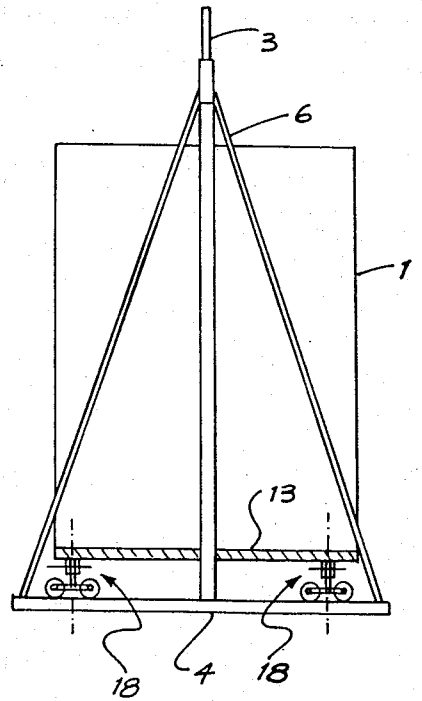
FIG. 8 is a side elevation of the construction shown in FIG. 7.
Figure 7:
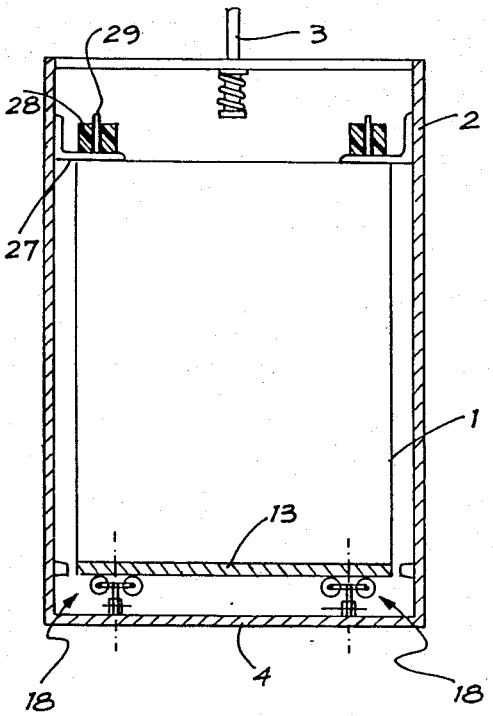
FIG. 7 is a diagrammatic part sectional front elevation similar to FIG. 1 but showing a second embodiment of the invention.
Figure 9:
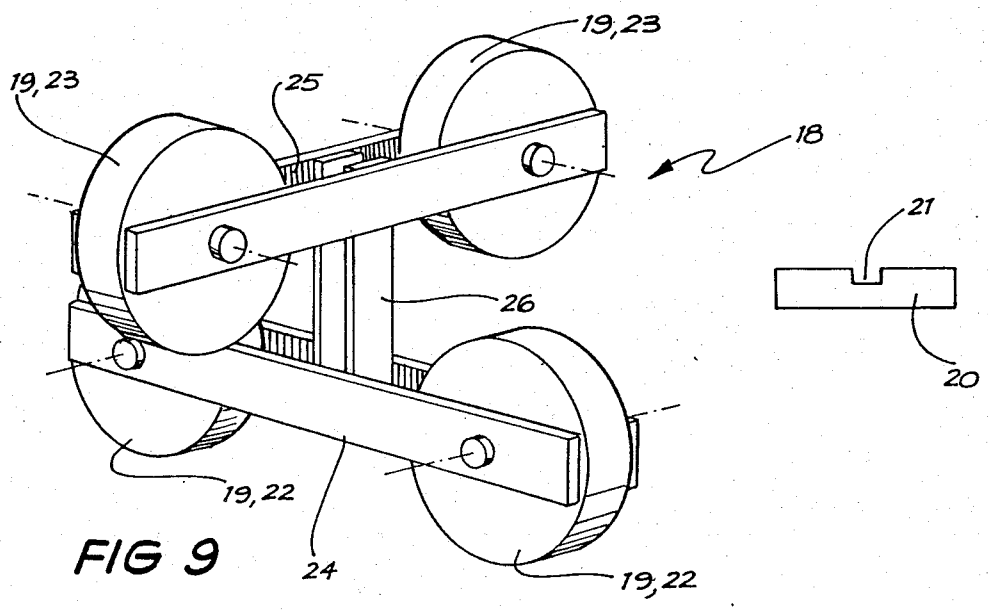
FIG. 9 is perspective view of one of the bogies used in the second embodiment of the invention.

In the preferred form of the invention as shown in FIGS. 7 to 9, the first pair of rails are mounted on the frame 4 and the second pair of rails on the underside of the lift car floor 13. The sets of followers are mounted back-to-back in a plurality of bogies 18 (as typically shown in FIG. 9), each bogie incorporating one of said first set of followers and one of said second set of followers. Four such bogies are provided located at the corners of the rectangle defined by the rails, and the followers incorporate wheels or rollers 19 having peripheries shaped to engage and follow the rails which are provided with corresponding profiles. For example in the configuration shown diagrammatically in FIG. 9, the wheels have plain flat peripheries and the rails, typically shown in cross-section at 20, are provided with rectangular section grooves 21 in which the wheels 19 run. It is preferred that the wheels are provided in tandem pairs with the pair of wheels 22 in the first set of followers being positioned to support the bogie 18 on the first pair of rails and the pair of wheels 23 in the second set of followers being positioned to support the second set of rails, and hence the floor of the lift car, on the bogies. In the form of bogie diagrammatically shown in FIG. 9, the first set of wheels are supported on cross arms 24 and the second set of wheels on cross arms 25, vertically spaced above and positioned at right angles to the cross arms 24 by a central column 26.

Although the invention has thus far been described with the lift car being supported by its floor 13 from a lower frame 4, it will be apparent that the entire support structure could be located above the lift car which is suspended from its roof.

It is desirable to provide limit stops to restrain the amplitude of movement of the lift car in any one direction which is typically no greater than 10 mm from a central datum. The limit stops may conveniently be provided in the form of brackets 27 on the lift cage 2 which support circular resilient collars 28. The lift car 1 is provided with pins 29 extending upwardly from the lift car within the collars 28 and provided with a radial clearance therebetween to allow the desired amplitude of motion of the lift car relative to the cage 2.

It is also desirable that the support mechanism be provided with a positive centralising device to centralise the position of the lift car to its datum positions when the lift car is stopped at a particular floor of a building for the entry or exit or passengers. Such a centralising device will now be described with reference to FIGS. 10 and 11 of the accompanying drawings.

The centralising device comprises a horizontal track 30 on which is slidably mounted a pair of trucks 31 which may typically be supported and guided for linear motion on the track by way of guide rollers 32. The trucks are provided with upwardly extending abutments 33 each having a V-shaped cross-section with the included angle of the V facing outwardly as shown in the drawings, conveniently formed from lengths of angle iron.

The motion of the trucks toward and away from one another is controlled by a toggle brace mechanism 34 having toggle arms 35 pivotally mounted to the trucks at their outer ends by way of vertical pivot pins 36 and pivotally connected to a central knuckle 37. The central knuckle of toggle is movable transversely by a linear actuator 38 causing the outer ends of the toggle and the abutments 33 to move toward and away from one another, to and from retracted and extended positions. The linear actuator 38 could conveniently comprise a worm and rack mechanism driven by an electric motor 39 but may be of any other known alternative such as a hydraulic piston and cylinder assembly.

Figure 10:
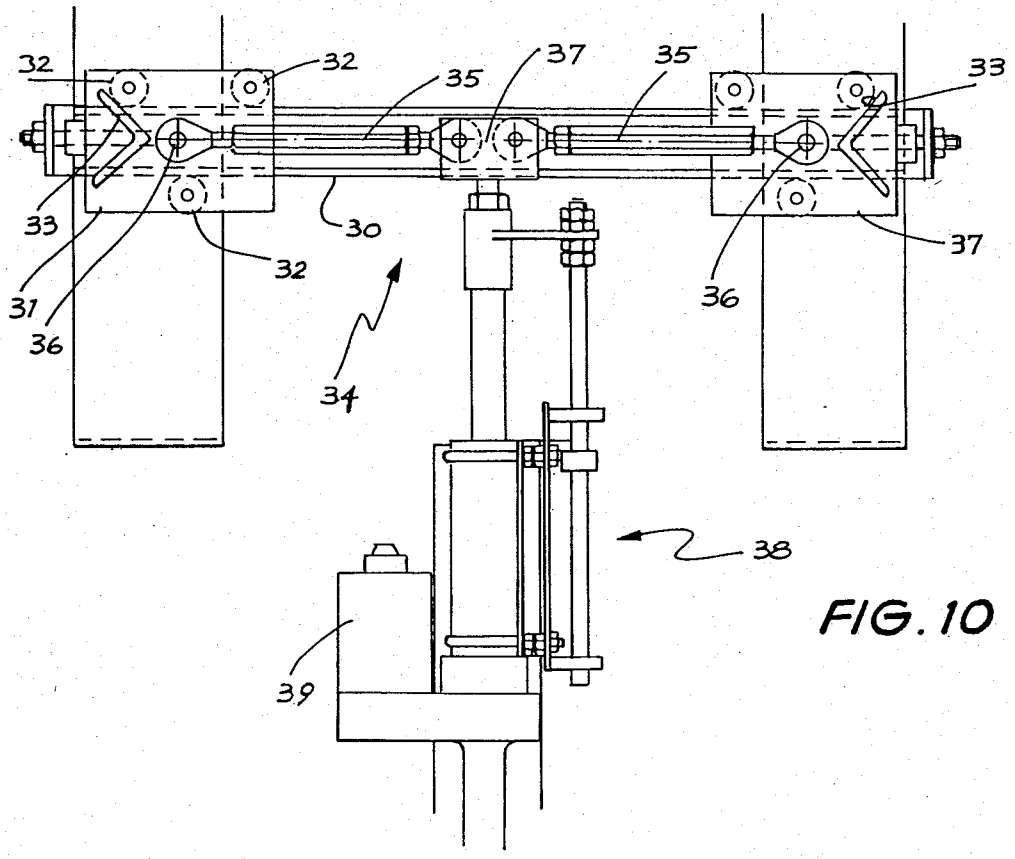
FIG. 10 is a plan view of a centralising device used in a lift car according to the invention, in the extended position.

The centralising device described above is mounted on the frame 4 so that the abutments 33 protrude upwardly to a position adjacent the underside of the lift cage floor 13. The underside of the lift cage floor is provided with two downwardly extending axles (not shown) on which are rotatably mounted wheels adapted to nestle in said V-shaped abutments when the abutments are in the extended position as shown in FIG. 10. The wheels are preferably ball races mounted on the downwardly extending vertical axles.

Figure 11:
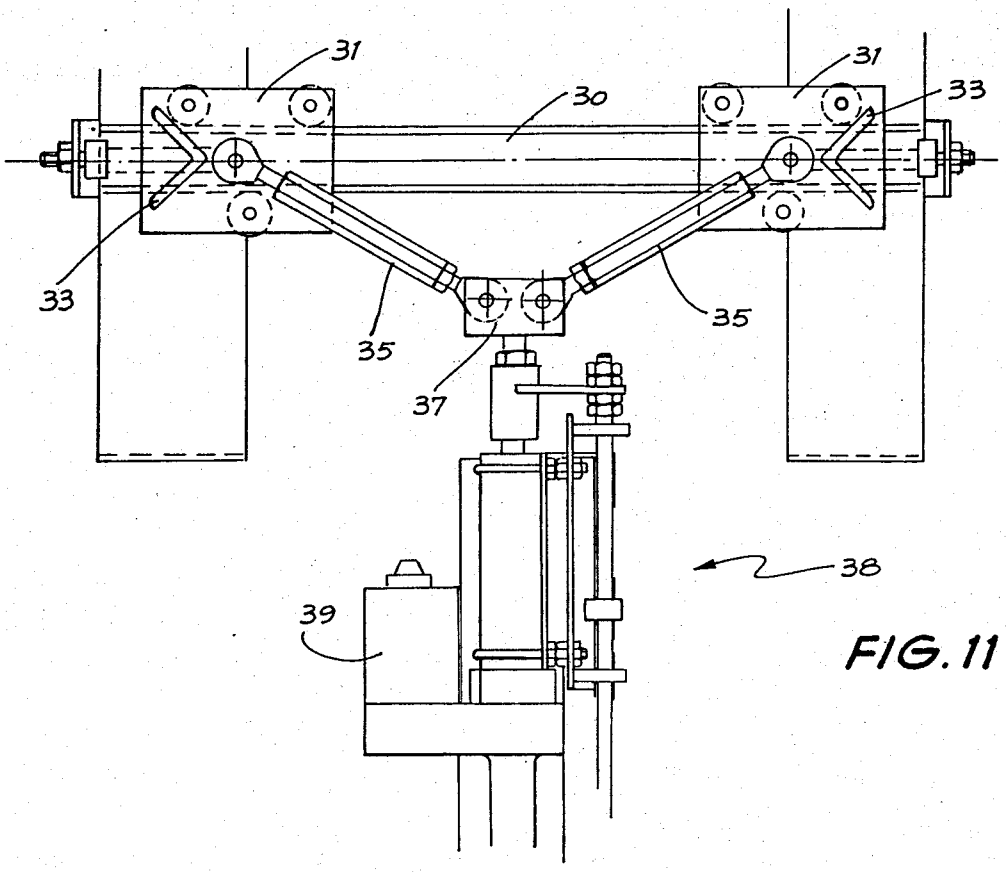
FIG. 11 is a similar view to FIG. 10 in the retracted position.

When the lift is moving between floors the centralising device is moved to the retracted position as shown in FIG. 11 so that the abutments 33 are clear of the ball races enabling the lift car to move transversely as previously described. Once the lift car reaches a floor and the doors are about to be opened, the linear actuator is actuated to move the toggle brace into the extended position as shown in FIG. 10, causing the ball races to roll on the arms of the angle iron abutments until they nestle in a predetermined centralised position within the V of each abutment.

In this manner a lift car support structure is provided which enables transverse vibrations in a horizontal plane to be absorbed by movement of the lift cage without transmitting that movement to the lift car and disturbing the occupants thereof.

What we claim is:

1. A support structure for a lift car, comprisinga frame adapted to be connected to a lift hoisting mechanism to support the lift car, first and second pairs of parallel rails arranged substantially horizontally in a parallelogram configuration between the lift car and the frame, and first and second sets of followers arranged to roll or slide on said first and second pairs of rails respectively, said lift car being supported from said frame by way of said rails and followers in a manner such that one pair of rails is supported from the other pair of rails by way of at least one said set of followers and can traverse along the line of the other pair of rails, allowing the lift car to move in any horizontal direction relative to the frame, said first pair of rails being mounted on said frame, said second pair of rails being mounted on said first set of followers, and said lift car being mounted on said second set of followers.

2. A support structure for a lift car, comprising a frame adapted to be connected to a lift hoisting mechanism to support the lift car, first and second pairs of parallel rails arranged substantially horizontally in a parallelogram configuration between the lift car and the frame, said first pair of rails being mounted on the frame, said second pair of rails being mounted on the lift car, and first and second sets of followers arranged to roll or slide on said first and second pairs of rails respectively, said sets of followers being mounted back-to-back in a plurality of bogies, each bogie incorporating one of said first set of followers and one of said second set of followers, four said bogies being provided, located at the corners of said parallelogram, said followers incorporating wheels or rollers having peripheries shaped to engage and follow said rails which are provided with corresponding profiles, and said wheels being provided in tandem pairs in each said bogie, the pair of wheels in said first set of followers being positioned to support the bogie on said first set of rails, and the pair of wheels in said second set of followers being positioned to support said second set of rails on said bogies, said lift car being supported from said frame by way of said rails and followers in a manner such that one pair of rails is supported from the other pair of rails by way of at least one said set of followers and can traverse along the line of the other pair of rails allowing the lift car to move in any horizontal direction relative to the frame.

3. A support structure for a lift car, comprising a frame adapted to be connected to a lift hoisting mechanism to support the lift car, first and second pairs of parallel rails arranged substantially horizontally in a parallelogram configuration between the lift car and the frame, first and second sets of followers arranged to roll or slide on said first and second pairs of rails respectively, and biasing means to bias said first set of followers to a datum position on said first pair of rails, and to bias said second set of followers to a datum position on said second pair of rails, said lift car being supported from said frame by way of said rails and followers in a manner such that one pair of rails is supported from the other pair of rails by way of at least one said set of followers and can traverse along the line of the other pair of rails allowing the lift car to move in any horizontal direction relative to the frame.

4. A support structure for a lift car as claimed in claim 3, wherein said biasing means are arranged to have a relatively small biasing force at positions immediately adjacent said datum positions, increasing with displacement from said datum positions.

5. A support structure for a lift car as claimed in claim 3, wherein said biasingmeans are adapted to give a very low natural transverse vibration frequency in the order of 1 Hz, of the lift car relative to the frame.

6. A support structure for a lift car, comprising a frame adapted to be connected to a lift hoisting mechanism to support the lift car, first and second pairs of parallel rails arranged substantially horizontally in a parallelogram configuration between the lift car and the frame, first and second sets of followers arranged to roll or slide on said first and second pairs of rails respectively, said lift car being supported from said frame by way of said rails and followers in a manner such that one pair of rails is supported from the other pair of rails by way of at least one said set of followers and can traverse along the line of the other pair of rails allowing the lift car to move in any horizontal direction relative to the frame, and positive centralizing means to centralize the lift car to a datum position relative to the frame when the lift is stationary, said centralizing means comprising a toggle brace arrangement mounted on said frame, wherein the central knuckle of the toggle is movable transversely by a linear actuator causing the outer ends of the toggle to move toward and away from one another, to and from retracted and extended positions, and wherein said outer ends of the toggle mechanism are provided with engagement means adapted to engage parts of said lift car in the extended position and to disengage therefrom in the retracted position.

7. A support structure for a lift car as claimed in claim 6, wherein said engagement means comprise abutments, V-shaped in plan view, and said parts of said lift car comprise vertical axles on which are rotatably mounted wheels adapted to nestle in said V-shaped abutments in said extended position.

* * * * *